US008172626B1

(12) United States Patent
Chang

(10) Patent No.: US 8,172,626 B1
(45) Date of Patent: May 8, 2012

(54) THREE-PIN ELECTRICAL PLUG WITH IMPROVED TERMINAL STRUCTURE

(76) Inventor: Min-Chen Chang, Taichung (TW)

( * ) Notice: Subject to any disclaimer, the term of this patent is extended or adjusted under 35 U.S.C. 154(b) by 0 days.

(21) Appl. No.: 13/181,534

(22) Filed: Jul. 13, 2011

(51) Int. Cl.
*H01R 13/02* (2006.01)

(52) U.S. Cl. ..... 439/884

(58) Field of Classification Search ..... 439/884, 439/885, 888, 890, 418, 676
See application file for complete search history.

(56) References Cited

U.S. PATENT DOCUMENTS 5,643,012 A * 7/1997 Mai et al. ..... 439/620.29
5,791,941 A * 8/1998 Wang ..... 439/620.29
5,851,127 A * 12/1998 Huang ..... 439/620.29
5,876,250 A * 3/1999 Deng ..... 439/620.3
6,461,195 B2 * 10/2002 Chang ..... 439/620.32
6,544,058 B1 * 4/2003 Chang ..... 439/173
2003/0207626 A1 * 11/2003 Chang ..... 439/877

* cited by examiner

*Primary Examiner* — Tulsidas C Patel
*Assistant Examiner* — Phuongchi Nguyen

(57) ABSTRACT

A three-pin electrical plug with improved terminal structure includes an earth pin, two terminals and a plug body. The terminal has a blade portion, a joint portion and a wire-gripping portion. The terminal further has a first axis passing through a widthwise center of the blade portion; a second axis being parallel to the first axis and passing through a widthwise center of the joint portion; and a third axis being parallel to both of the first axis and the second axis, and passing through a widthwise center the wire-gripping portion, wherein the third axis coincides with neither the first axis nor the second axis. Thereby, a mold for deforming the wire-gripping portion can have its side walls made thicker so as to extend the service life of the mold. Thus, the improved terminal structure is conductive to mass manufacturing of the plug in terms of both efficiency and cost.

6 Claims, 6 Drawing Sheets

THREE-PIN ELECTRICAL PLUG WITH IMPROVED TERMINAL STRUCTURE

BACKGROUND OF THE INVENTION

1. Technical Field

The present invention relates to electrical plugs, and more particularly, to a three-pin electrical plug with improved terminal structure, wherein the plug, in virtue of the structural improvement in its terminals, is conductive to mass manufacturing in terms of both efficiency and cost.

2. Description of Related Art

A three-pin electrical plug features an earth pin for connecting the ground for safety in addition to its two conductive blades, also known as terminals.

Referring to FIGS. 1 through 3, for making a conventional three-pin electrical plug, two terminals 91 and an earth pin 93 have to be pre-made and arranged on a plug body 95. For making the terminal 91, a plurality of preforms 91' is formed in batch. Each of the preform 91' has a blade portion 911, a joint portion 912 and a wire-gripping portion 913. Traditionally, as shown clearly in FIG. 2, the preform 91' is symmetrical about its lengthwise central axis A9 (a line through centers of the blade portion 911, the joint portion 912 and the wire-gripping portion 913). In other words, basing on the axis A9, both the blade portion 911 and the wire-gripping portion 913 have two halves thereof equally extended to the same width, namely W91 being equal to W92 while W93 is equal to W94. Preforms 91' such made are then separated and twisted into a terminal 91 to be arranged on the plug body 95 together with the earth pin 93 and another said terminal 91, as shown in FIG. 3. As can be seen in FIGS. 3 and 4, the terminal 91 at this time has its wire-gripping portion 913 shaped into a U-like shaped with its two halves lifted symmetrically.

Referring to FIG. 5, the plug body 95 carrying the terminals 91 and the earth pin 93 is then subjected to a wire-fixing process where a pressing mold 80 with dies 81, 83 is used to deform the wire-gripping portions of the earth pin 93 and terminals 91 so as to affix conductive wires 85 thereon. For fitting the terminals 91 arranged as described above, the first dies 81 flanking the second die 83 have a shortest distance therebetween much shorter than the shortest distance between the axes (i.e. the blade portions 911 of the terminals 91) of the two conductive wires 85 corresponding thereto. Consequently, in the confined mold 80, side walls 811 of the first dies 81 bordering the second die 83 are necessarily thin, and this being a major problem to the prior art. That is, the thin side walls 811 of the first dies 81 tend to break over the repeated pressing operation.

Since either repair or replacement of the dies or the mold is costly, there is a need to develop a scheme that is conductive to mass manufacturing of a three-pin electrical plug in terms of both efficiency and cost without changing the relative position of its earth pin and terminals so that the improved three-pin electrical plug is still compatible to existing power outlets.

SUMMARY OF THE INVENTION

In view of such a need, the primary objective of the present invention is to provide a three-pin electrical plug with improved terminal structure.

According to the present invention, the three-pin electrical plug comprises an earth pin, two terminals, and a plug body holding the earth pin and the two terminals, wherein each of the terminals has a blade portion for being inserted into an external power outlet, a joint portion being adjacent to the blade portion and a wire-gripping portion that is connected to the blade portion through the joint portion and is configured to grip a conductive wire, the three-pin electrical plug being characterized in that each of the terminal comprising: a first axis passing through a widthwise center of the blade portion and extending in a length of the blade portion; a second axis being parallel to the first axis and passing through a widthwise center of the joint portion; and a third axis being parallel to both of the first axis and the second axis, and passing through a widthwise center the wire-gripping portion, wherein the third axis coincides with neither the first axis nor the second axis.

In one aspect of the present invention, the wire-gripping portion is asymmetric about the first axis.

In another aspect of the present invention, the first and second axes coincide with each other.

In another aspect of the present invention, the wire-gripping portion is asymmetric about both the first and second axes.

In another aspect of the present invention, the wire-gripping portion has a width greater than a width of the blade portion.

In another aspect of the present invention, the wire-gripping portion and the blade portion have a respective lengthwise edge thereof parallel to the first axis at a same side of the first axis being substantially level with each other.

Thereby, a mold for deforming the wire-gripping portion can have its walls made thicker so as to extend the service life of the mold. Thus, the improved terminal structure is conductive to mass manufacturing of the plug in terms of both efficiency and cost.

BRIEF DESCRIPTION OF THE DRAWINGS

The invention as well as a preferred mode of use, further objectives and advantages thereof will be best understood by reference to the following detailed description of an illustrative embodiment when read in conjunction with the accompanying drawings, wherein.

DETAILED DESCRIPTION OF THE INVENTION

Referring to FIGS. 6 through 9, a three-pin electrical plug of the present invention has two terminals 11 and an earth pin 13 arranged on a plug body 15.

Figure 9:
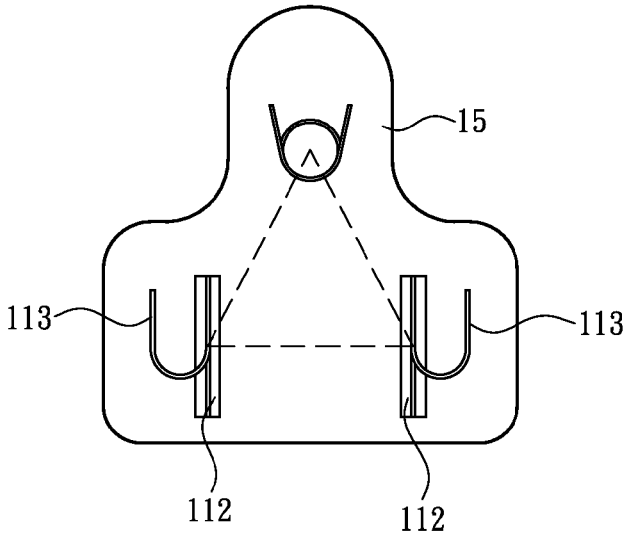

For making the terminal 11, a plurality of preforms 11' is formed in batch. Each of the preform 11' has a blade portion 111, a joint portion 112 and a wire-gripping portion 113. In each of the preform 11', as shown clearly in FIG. 7, there is an axis A1 passing through a widthwise center of the blade portion 111 and extending in a length of the blade portion 111 (i.e. a central axis of the blade portion 111). In the illustrated embodiment, the axis A1 also passes through a widthwise center of the joint portion 112 and extending in a length of the joint portion 112. The preform 11' also has another axis A2 being parallel to the foregoing axis A1 and passing through a widthwise center of the wire-gripping portion 113 (i.e. a central axis of the wire-gripping portion 113). As shown, the axis A2 does not coincides with the axis A1. As illustrated, the wire-gripping portion 113 is greater than the blade portion 111 in width, and one edge of the wire-gripping portion 113 substantially level with one edge of the blade portion 111 at the same side of the axis A1. In other words, the wire-gripping portion 113 is asymmetric about the axis A1. As reflected in FIG. 7, the blade portion 111 has its two halves about the axis A1 being of the equal width W11 and W12, while the wire-gripping portion 113 has its two halves about the axis A1 being of the different widths W13 and W14, wherein W14 is greater than W13. Then the separated preforms 11' can be easily made into the terminals 111 by curving the wire-gripping portion 113 from one end bordering the half having the width W14, opposite to the prior art where the preform has to be twisted to form the terminal. Referring now to FIG. 9, the terminal 11 at this time has the wire-gripping portion 113 formed into a U-like shape with two upward extending arms, wherein one of the arms is aligned with the blade portion 111 and the joint portion 112.

Figure 1:
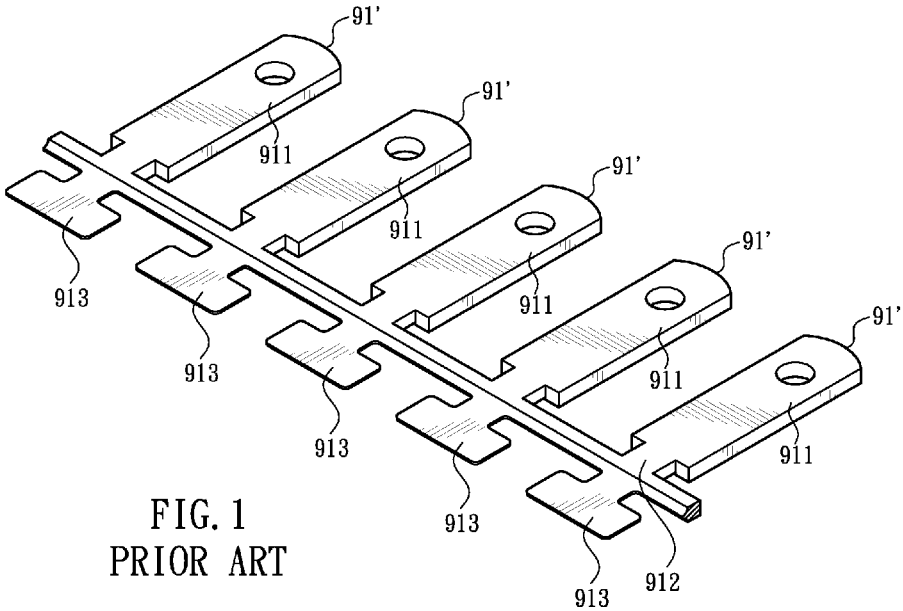
FIG. 1 PRIOR ART
FIGS. 1 and 2 depict preforms of conventional terminals for electrical plugs.
Figure 2:
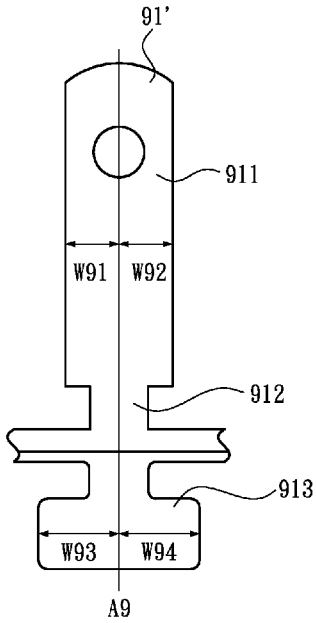
FIG. 2 PRIOR ART
Figure 3:
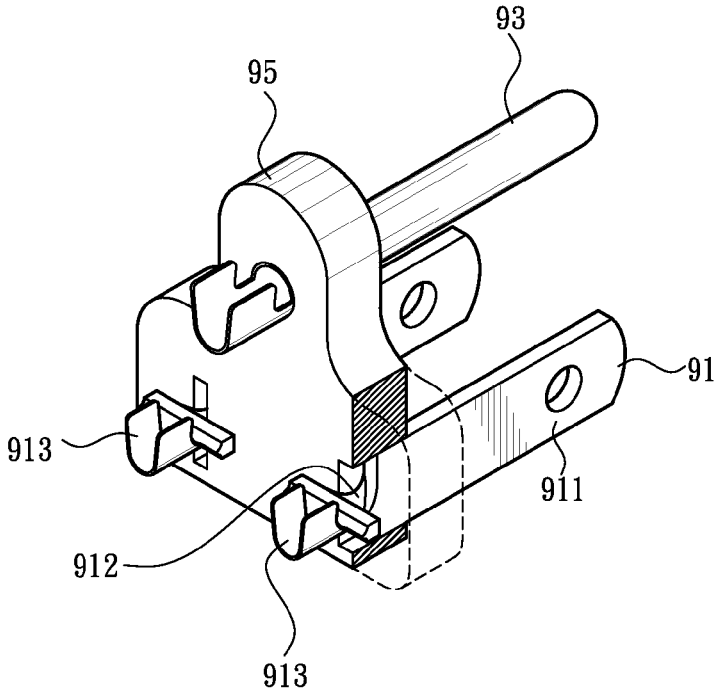
FIG. 3 PRIOR ART
FIGS. 3 and 4 illustrate a semi-product of an electrical plug carrying the terminals made from the preforms of FIG. 1.
Figure 4:
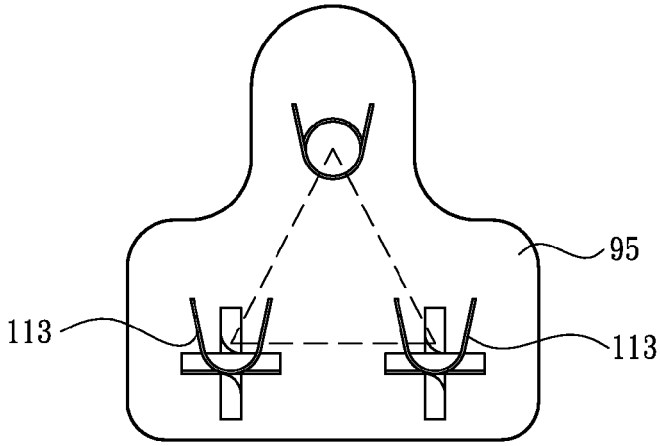
FIG. 4 PRIOR ART
Figure 5:
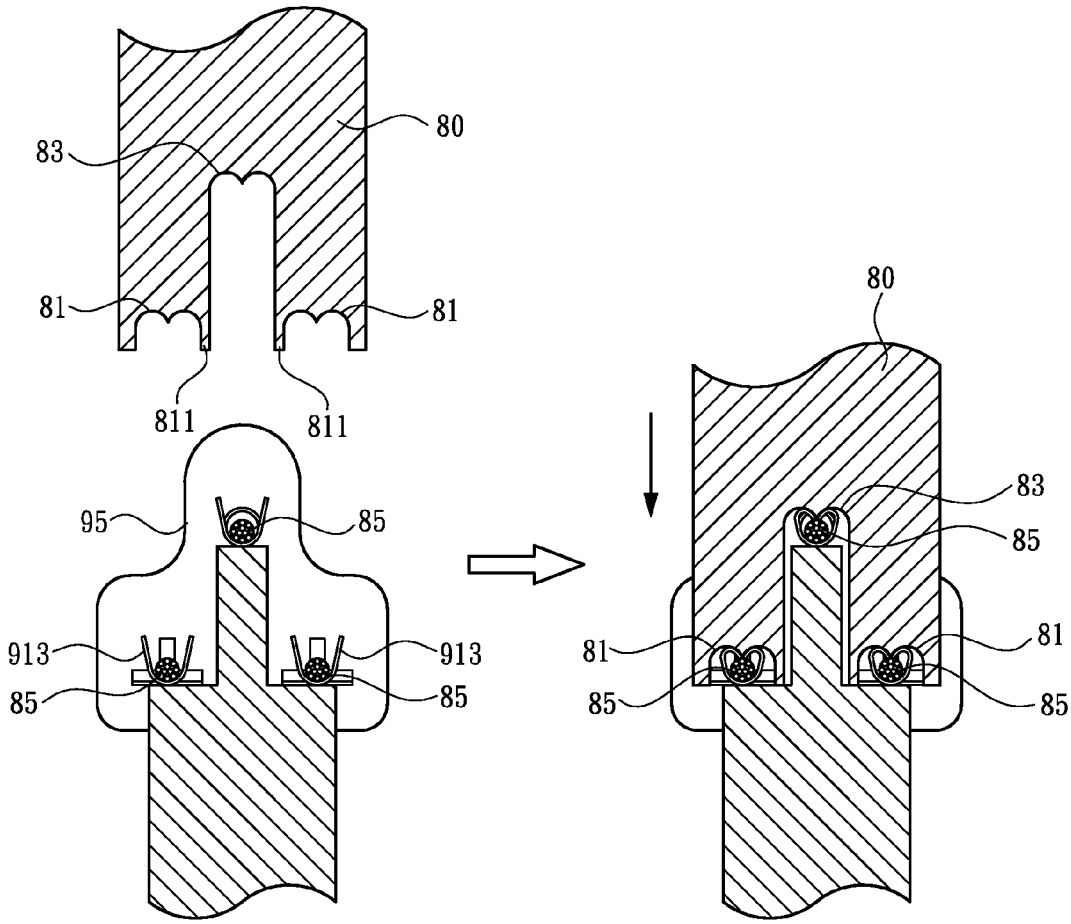
FIG. 5 PRIOR ART
FIG. 5 illustrates a wire-fixing process where a mold is used to affix wires to the semi-product of FIG. 3.
Figure 6:
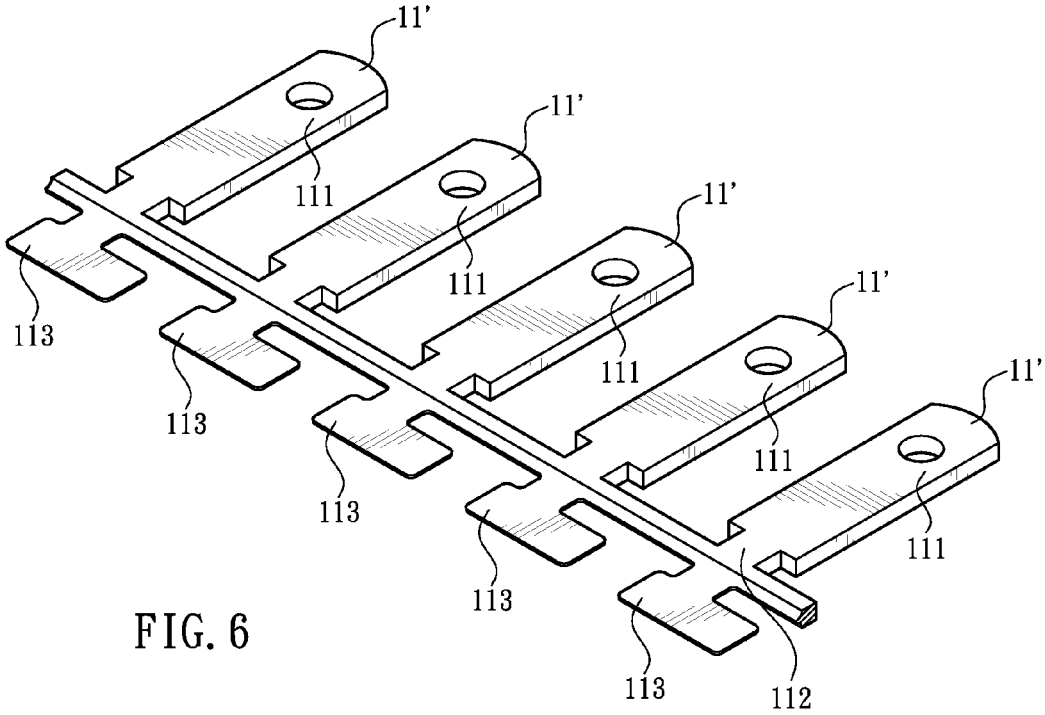
FIGS. 6 and 7 depict preforms of terminals for electrical plugs according to the present invention.
Figure 7:
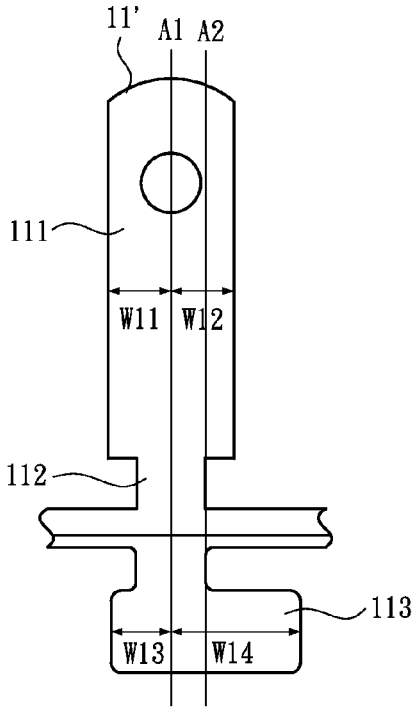
Figure 8:
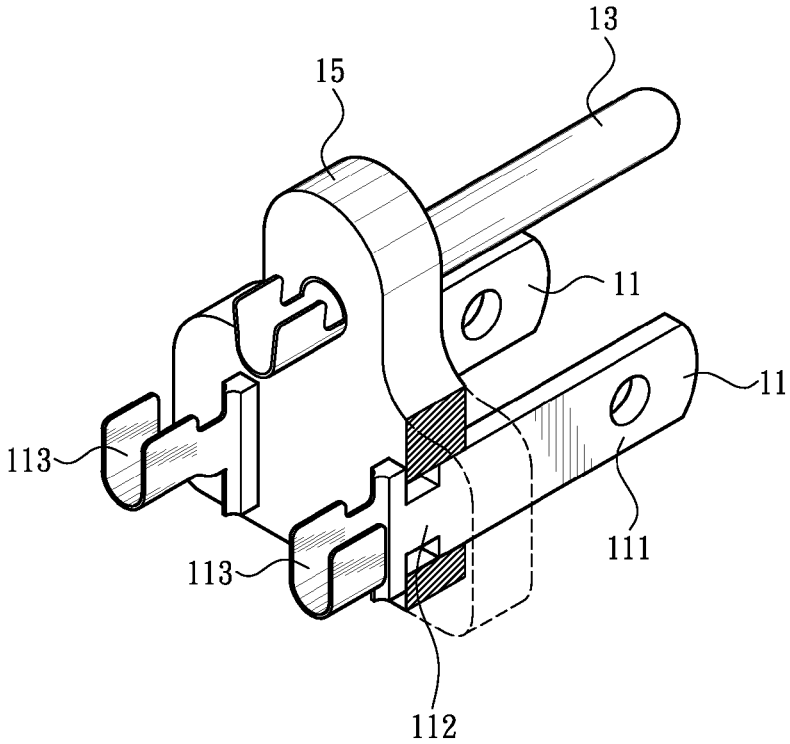
FIGS. 8 and 9 illustrate a semi-product of an electrical plug according to the present invention, which carries the terminals made from the preforms of FIG. 6.

The terminal 11 such formed can then be installed onto the plug body 15 together with the earth pin 13 and another said terminal 11, as shown in FIGS. 8 and 9. Comparing FIG. 9 with FIG. 4, it can be seen that without changing the relative position among the earth pin 13 (93) and the terminals 11 (91), as depicted by the dotted-line triangles in the drawings, the terminals 11 of the present invention substantially enlarges the shortest distance between the two U-shaped wire-gripping portions 113.

Figure 10:
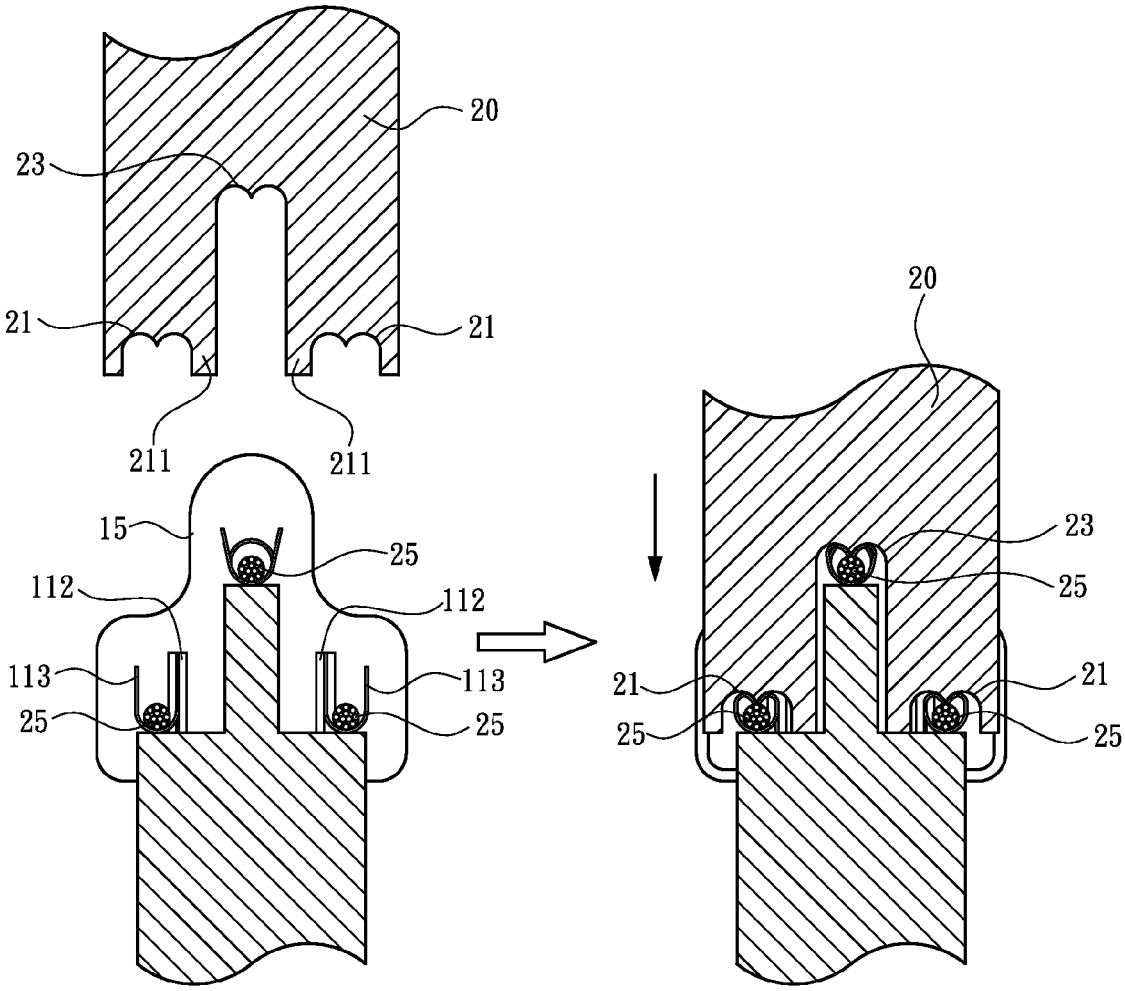
FIG. 10 illustrates a wire-fixing process where a mold is used to affix wires to the semi-product of FIG. 8.

Referring to FIG. 10, the plug body 15 carrying the terminals 11 and the earth pin 13 is then subjected to a wire-fixing process where a pressing mold 20 with dies 21, 23 is used to deform the wire-gripping portions of the earth pin 13 and terminals 11 so as to affix conductive wires 25 thereon. As described above, the shortest distance between the two U-shaped wire-gripping portion 113 is enlarged as compared with the prior art plug. As a result, the first dies 21 flanking the second die 23 can accordingly have their side walls 211 made with enlarged thickness as compared with the conventional mode used for making the prior art plug.

To sum up, the present invention helps to simplify the process for making a preform into a terminal, and most importantly, it allows the mode for deforming the wire-gripping portion 113 of the plug to be made with enlarged thickness. With the thickened side walls 211, the mode 20 is more durable, and consequently is conductive to mass manufacturing in terms of both efficiency and cost of the plug products.

The present invention has been described with reference to the preferred embodiment and it is understood that the embodiment is not intended to limit the scope of the present invention. Moreover, as the contents disclosed herein should be readily understood and can be implemented by a person skilled in the art, all equivalent changes or modifications which do not depart from the concept of the present invention should be encompassed by the appended claims.

What is claimed is:

1. A three-pin electrical plug with improved terminal structure comprising an earth pin, two terminals, and a plug body holding the earth pin and the two terminals, wherein each of the terminals has a blade portion for being inserted into an external power outlet, a joint portion being adjacent to the blade portion and a wire-gripping portion that is connected to the blade portion through the joint portion and is configured to grip a conductive wire, the three-pin electrical plug being characterized in that each of the terminal comprises:

two side edges of the joint portion are continuously extending from two side edges of the blade portion to two side edges of the wire gripping portion without any interrupted portion;

a first axis passing through a widthwise a center of the blade portion and extending in a length of the blade portion, the length of the blade portion defined from a mating end to a wire griping end of the pin electrical plugs;

a second axis being parallel to the first axis and passing through a most end edge of the joint portion; and a third axis being parallel to both of the first axis and the second axis, and passing through a widthwise center of the wire-gripping portion, wherein the third axis coincides on the second axis or neither on both first axis and second axis.

2. The three-pin electrical plug of claim 1, wherein the wire-gripping portion is asymmetric about the first axis.

3. The three-pin electrical plug of claim 1, wherein the first and second axes coincide with each other.

4. The three-pin electrical plug of claim 3, wherein the wire-gripping portion is asymmetric about both the first and second axes.

5. The three-pin electrical plug of claim 1, wherein the wire-gripping portion has a width greater than a width of the blade portion.

6. The three-pin electrical plug of claim 5, wherein the wire-gripping portion and the blade portion have a respective lengthwise edge thereof parallel to the first axis at a same side of the first axis being substantially level with each other.

* * * * *